US005086537A

United States Patent [19]

McDowell et al.

[11] Patent Number: 5,086,537

[45] Date of Patent: Feb. 11, 1992

[54] COMPACT EXTRACTOR

[75] Inventors: David E. McDowell, Grand Rapids; Robert A. Yonkers, Grandville, both of Mich.

[73] Assignee: Bissell, Inc., Grand Rapids, Mich.

[21] Appl. No.: 621,889

[22] Filed: Dec. 4, 1990

[51] Int. Cl.[5] ..... A47L 7/00

[52] U.S. Cl. ..... 15/353; 15/410; 55/165; 55/246

[58] Field of Search ..... 15/353, 410; 55/165, 55/169, 170, 246

[56] References Cited

U.S. PATENT DOCUMENTS

| | | | |
|---|---|---|---|
| 3,101,889 | 8/1963 | Tatge . | |
| 3,720,977 | 3/1973 | Brycki | 15/353 X |
| 3,858,272 | 1/1975 | Bard et al. | 15/410 X |
| 4,185,354 | 1/1980 | Brazier . | |
| 4,218,805 | 8/1980 | Brazier . | |
| 4,287,636 | 9/1981 | Brazier . | |
| 4,361,928 | 12/1982 | Schulz . | |
| 4,533,370 | 8/1985 | Ikezaki et al. . | |
| 4,574,421 | 3/1986 | Froese | 15/339 |
| 4,706,326 | 11/1987 | Romani . | |
| 4,864,680 | 9/1989 | Blase et al. . | |

FOREIGN PATENT DOCUMENTS

| | | |
|---|---|---|
| 2038168 | 7/1980 | United Kingdom . |
| 1601456 | 10/1981 | United Kingdom . |
| 1602918 | 11/1981 | United Kingdom . |
| 1602919 | 11/1981 | United Kingdom . |

*Primary Examiner*—Chris K. Moore

*Attorney, Agent, or Firm*—Price, Heneveld, Cooper, DeWitt & Litton

[57] ABSTRACT

The present invention is a surface cleaning liquid extractor for vacuum cleaning a surface. The extractor has an open top recovery tank, a housing which seats upon the recovery tank and a convenient carrying handle which latches the housing and the recovery tank together. The extractor also has a floating splash damper positioned within the recovery tank for floating upon the surface of liquid collected in the tank to minimize splashing of the liquid. The top surface of the floating splash damper includes a domed portion for engaging the suction opening of the extractor and sealing off the suction from the recovery tank when the recovery tank has filled with liquid.

32 Claims, 4 Drawing Sheets

COMPACT EXTRACTOR

BACKGROUND OF THE INVENTION

The present invention relates to vacuum cleaning and to liquid extractor vacuum cleaners in particular. The concept of the liquid extraction vacuum is well known in the common household shop-style vacuum, as well as various home vacuum devices which are promoted as carpet and upholstery cleaning devices. Such liquid extractors typically have an open-top recovery tank to receive debris and liquid which is vacuumed up by the extractor and a removable housing which sits upon the top of the recovery tank as a lid. A suction device, typically an electric fan, for drawing air out of the recovery tank to create a suction and pull debris and liquid into the recovery tank is located in the housing and is in fluid communication with the recovery tank via an opening in the bottom of the housing. A suction hose is either connected directly to the recovery tank or is connected to the housing and is in fluid communication with the recovery tank via an opening in the bottom of the housing. At least two latching devices are commonly used to latch the housing in sealing contact with the recovery tank.

As the recovery tank fills with liquid, the fan can potentially draw liquid out of the recovery tank, through the fan suction opening in the bottom of the housing and blow dirty water around the room through the vacuum fan exhaust. Therefore, such extractors often have a float valve to cut off the air flow from the recovery tank to the fan when the liquid level in the recovery tank has reached a predetermined depth.

The float valve mechanism will typically comprise a float ball, which is sized to block the fan suction opening, and a cage, which is typically mounted to the bottom of the housing for aligning the ball with the fan suction opening. One exception is the extractor of U.S. Pat. No. 4,864,680 to Blase et al., issued Sept. 12, 1989, in which the float valve cage is mounted in the extractor recovery tank. As the liquid level in the recovery tank rises, the ball will float upon the surface of the liquid and be lifted towards the fan suction opening until the ball is actually drawn into the fan suction opening and seats in the opening to close the opening between the recovery tank and the fan. The ball-float arrangement does not always prevent water from splashing up into the suction opening and being exhausted. This is especially a problem in smaller, more compact units which are easily moved around in normal usage.

Such extractors are messy to use. The user must typically unlatch a plurality of latches in order to remove the housing. The underside of the housing, which is exposed to the interior of the recovery tank, and especially the ball and cage assembly, is typically dirty, wet or both so that a mess is created upon whatever surface the housing is set. This problem is accentuated by the fact that the float ball cage is typically mounted to the housing such that the cage surrounds the fan suction opening and protrudes from the bottom of the housing as noted above. The cage might also be covered with a dust filter which is especially prone to being covered with dirt and water from the recovery tank.

SUMMARY OF THE INVENTION

The splashing problem discussed above is addressed by the extractor of the present invention which includes a floating splash damper for suppressing the tendency of the liquid contents of the recovery tank to splash. In one aspect of the invention, the splash damper also provides the suction flow cutoff function when the recovery tank has filled with liquid.

In another aspect of the invention, a convenient and comfortable carry handle for carrying the complete extractor or just the recovery tank also latches the top housing to the recovery tank.

These and other objects, advantages and features of the present invention will become apparent upon review of the following specification in conjunction with the drawings

DESCRIPTION OF THE PREFERRED EMBODIMENT

Figure 1:
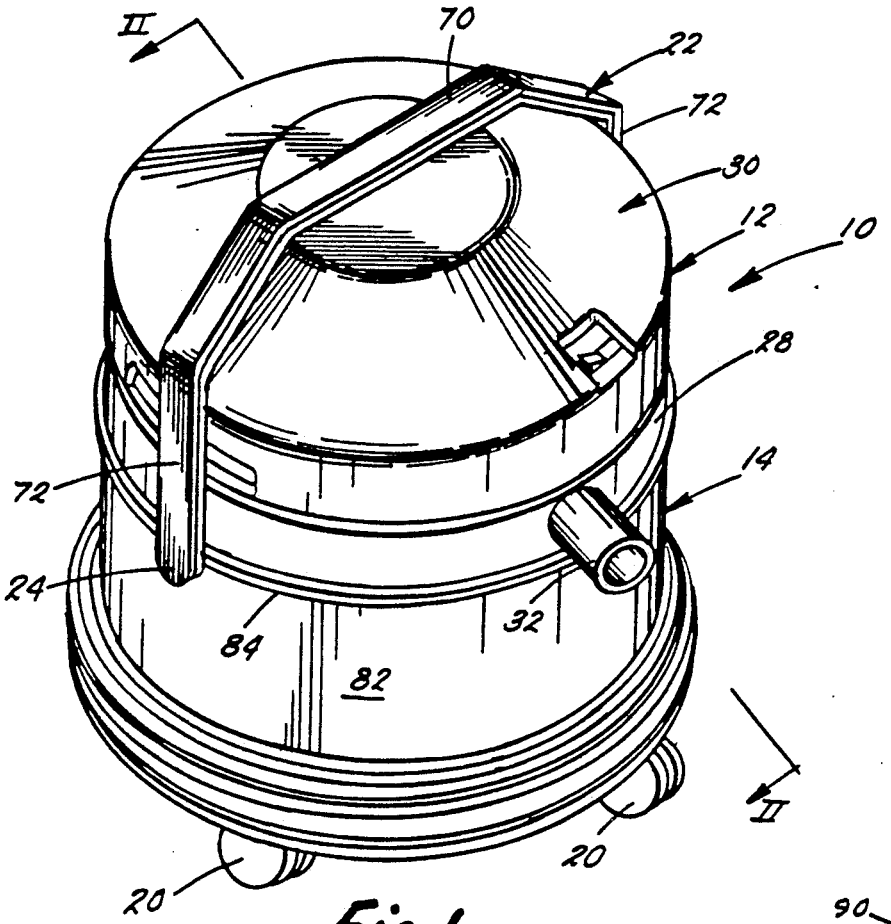
FIG. 1 is a perspective view of the extractor of the present invention.
Figure 5:
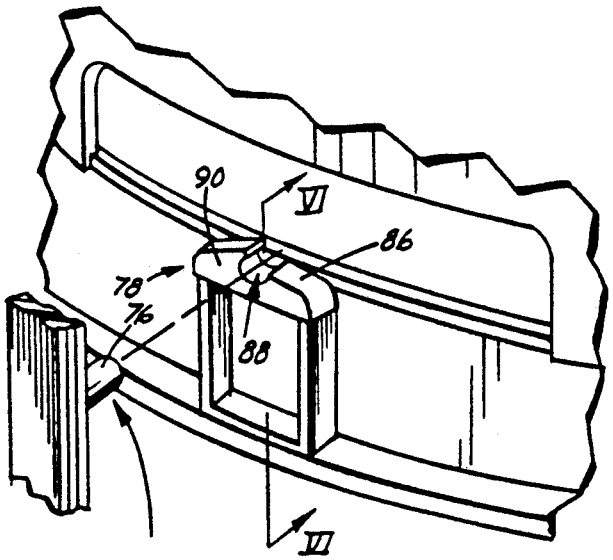
FIG. 5 is an exploded perspective of the detail V of FIG. 1.
Figure 2:
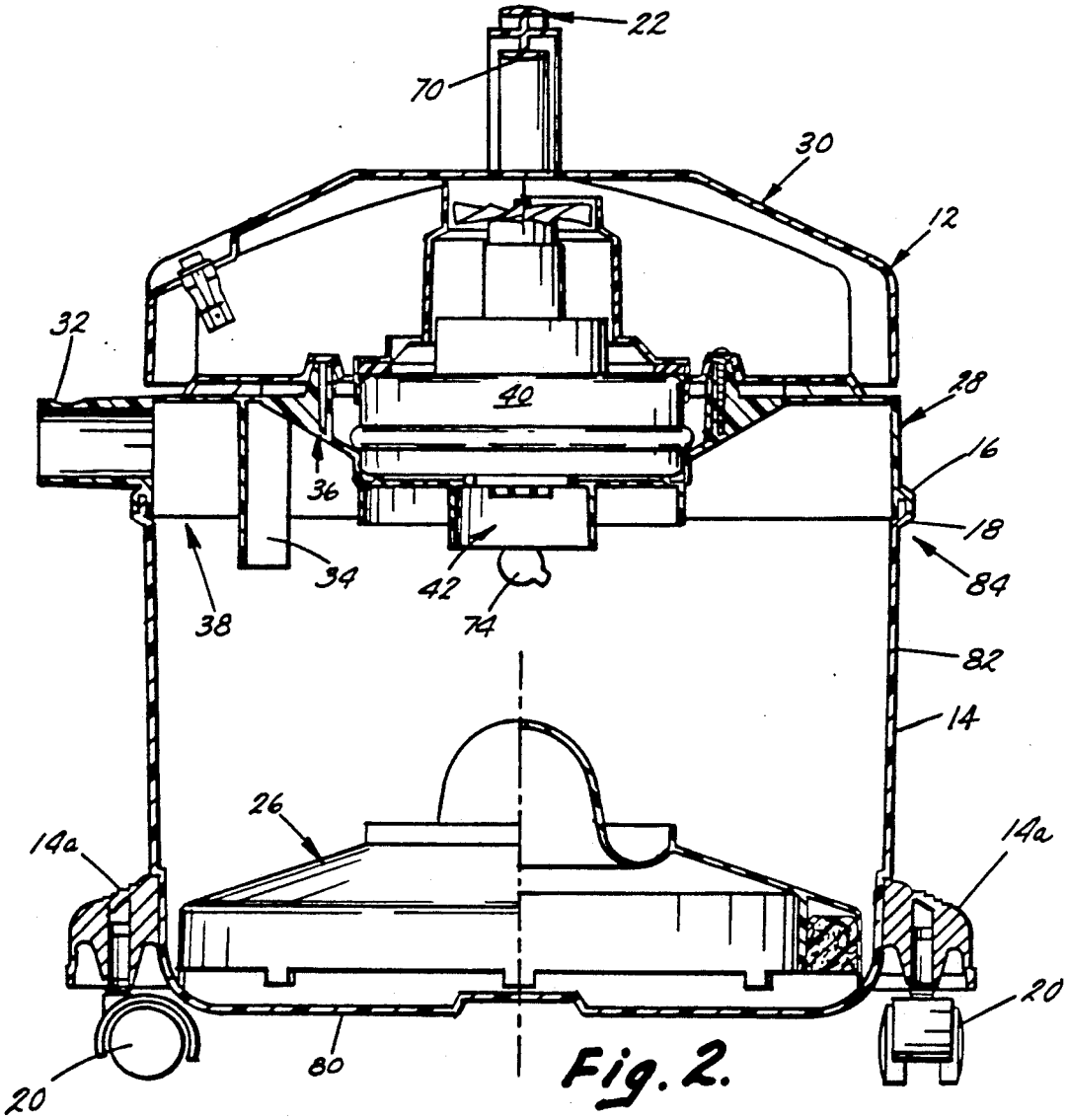
FIG. 2 is a center line sectional view of the extractor of FIG. 1 taken along section line II—II, the splash damper being shown in partial elevation—partial section.

In the preferred embodiment, extractor 10 comprises a housing 12 for vacuum motor 40 seated atop recovery tank 14 (FIGS. 1 and 2). A combined splash damper and cutoff float 26 floats on the surface of recovered water within recovery tank 14. Housing 12 is held in place by the combined handle and latch 22 which is pivotally mounted to recovery tank 14 (FIGS. 1 and 5).

Housing 12 is preferably molded of plastic and is generally cylindrically shaped with a vertical sidewall 28, a truncated conic top surface 30 and a suction hose connector 32 extending from vertical sidewall 28 Aligned with and inside of suction hose connector 32 is a water and air separator baffle 34. Baffle 34 is a curved wall which extends downwardly from the bottom surface 36 of housing 12, extending in front of hose connector 32. Baffle 34 is arcuately shaped and parallels sidewall 28 of housing 12. The curvature of baffle 34 helps to dissipate the energy of incoming, foamed recovery liquid and to separate air from liquid. An end wall (not shown) extends from each end of baffle 34 toward sidewall 28 of housing 12 forming a separator chamber 38.

A vacuum motor assembly 40 is mounted generally in the center of housing 12 and is in fluid communication with recovery tank 14 through a suction opening 42, generally centered in the bottom surface 36 of housing 12.

Housing 12 has a downwardly open channel 16 at the bottom edge of vertical sidewall 28 for receiving an upwardly projecting flange 18 which circumscribes the open top of generally cylindrically shaped recovery tank 14 (FIG. 2). The interaction of channel 16 and flange 18 assists in the alignment and placement of housing 12 upon recovery tank 14 and provides sealing engagement between housing 12 and recovery tank 14. Recovery tank 14 is preferably molded of a suitable plastic and includes caster sockets 14A for receiving the pintles of casters 20. Handle 22 is pivotally connected at each end 24 to recovery tank 14 (FIG. 1).

Figure 6:
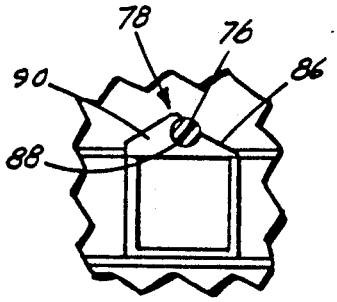
FIG. 6 is a partial sectional—partial elavational view taken along section line VI—VI of the detail of FIG. 5.

As shown in FIG. 1, handle 22 is an inverted U-shaped member having a central bight portion 70 which extends across the top of extractor 10. A leg 72 extends downwardly from each end of bight portion 70 to straddle extractor 10. The end 24 of each leg 72 has an inwardly projecting post with a laterally projecting tab at the inner end of the post to form a keyhole-shaped terminal end 74 (FIG. 2). Each end 74 is the mirror image of its opposing member. Two keyhole-shaped openings which conform to the shape of ends 72 are provided in the sidewall 82 of recovery tank 14, near the top edge 84 of sidewall 82 and offset about 180° from each other. An inwardly projecting latch post 76 is provided on each leg 72 at an intermediate position between end 24 and bight portion 70 to align with a catch 78 which is provided on housing 12 (FIGS. 5 and 6).

Two catches 78 are provided on sidewall 28 of housing 12 for cooperation with latch posts 76 to latch housing 12 and recovery tank 14 together when handle 22 is placed in a vertical position. Catches 78 are spaced approximately 180° apart from each other and approximately 90° from suction hose connector 30 (FIG. 1). Each catch 78 has an inclined surface 86 and a latch post receiving area 88 (FIGS. 5 and 6).

Figure 3:
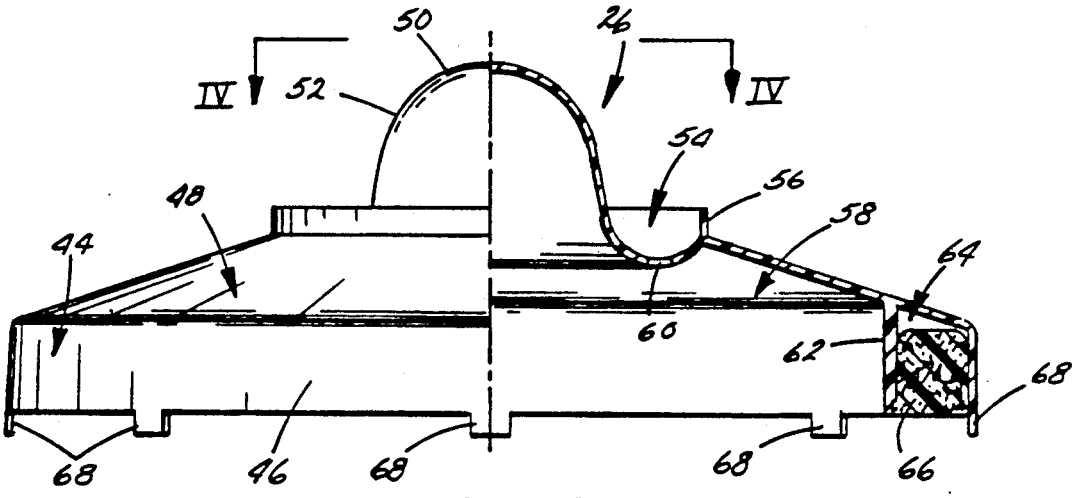
FIG. 3 is a partial sectional—partial elevational view of the splash damper.

Splash damper 26 is a splash damping, flotation device which floats upon the surface of liquid which is drawn into recovery tank 14, through suction hose connector 32, and collects inside recovery tank 14 (FIGS. 2 and 3). Splash damper 26 is a styrene plastic injection molding and is shaped in perimeter to reflect the interior lateral cross sectional shape of recovery tank 14. Therefore, in the embodiment shown, damper 26 is circular in plan view.

Figure 4:
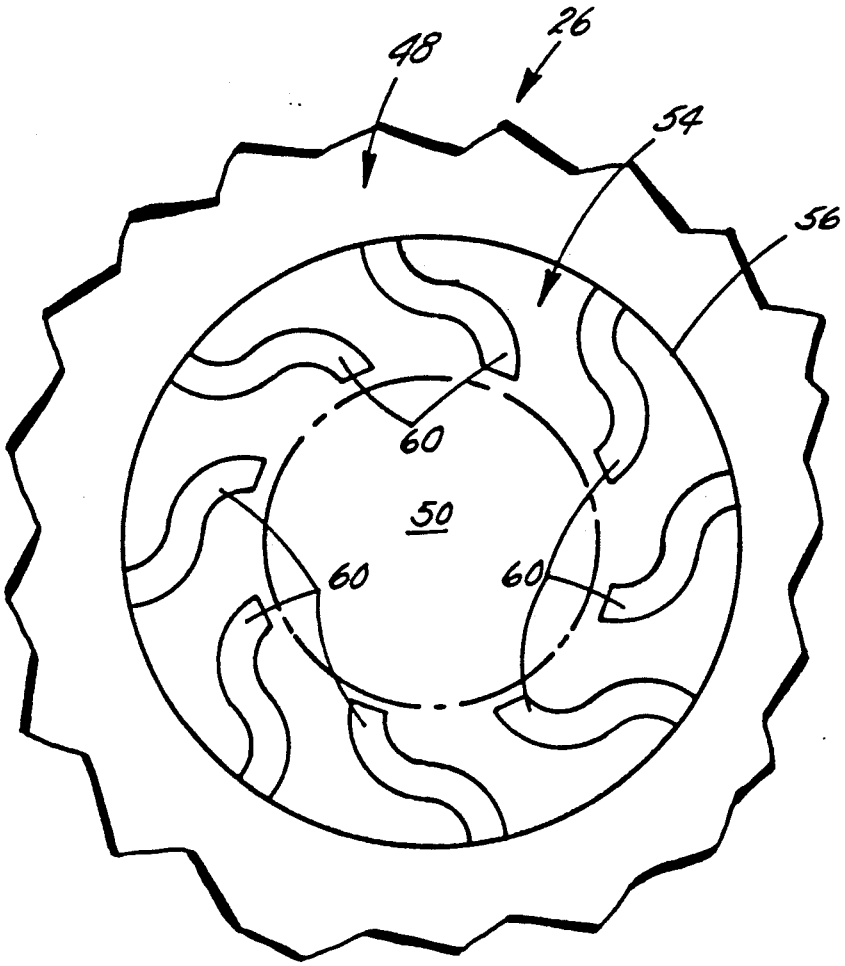
FIG. 4 is a fragmentary plane view of the splash damper of FIG. 3 as indicated by arrows IV—IV.

Damper 26 includes a cylindrical base portion 44 having vertical sidewall 46. Further, damper 26 has a truncated conic top surface 48 with a centrally located dome portion 50. Dome portion 50 has a steeply sloping sidewall 52 and is circumscribed by a trough 54 which extends between sidewall 52 and sloping top surface 48. A series of elongated, S-shaped openings 60 are positioned in the bottom of trough 54 to allow any foam or liquid which enters trough 54 to drain through splash damper 26 (FIG. 4). A wall circumscribes trough 54 and projects vertically upward from top surface 48 at the outer edge of trough 54 to form a foam dam 56 (FIG. 3).

Splash damper 26 is basically a hollow, open bottom shell defining a downwardly open chamber 58. An inner wall 62, which is parallel to and spaced inwardly from vertical sidewall 46, extends downwardly from top surface 48 of splash damper 26 to form a flotation chamber 64. A flotation material 66, such as a closed cell, expanded polystyrene is placed in flotation chamber 64 to assure the flotation of splash damper 26. A plurality of legs 68 extend downwardly from sidewall 46 of splash damper 26 to assure that liquid which is drawn into recovery tank 14 is not blocked from collecting beneath splash damper 26 and to assure that a suction does not hold splash damper 26 to the floor 80 of recovery tank 14.

Splash damper 26 effectively provides a continuous cover over the surface of liquid collected in recovery tank 14 to suppress any splashing of the liquid. This splash-damp damping function can be accomplished by covering at least approximately one-half and most preferably substantially all the surface area of liquid collected in recovery tank 14 with splash damper 26, leaving some space at the perimeter so that damper 26 does not bind with the recovery tank 14 sidewall and so that incoming water is not trapped above damper 26. Splash damper 26 also provides a cutoff function when recovery tank 14 is filled with liquid for blocking the suction created by motor 40. The cutoff function is accomplished by having dome portion 50 aligned with suction opening 42 in housing bottom surface 36 (FIG. 2). Thus, splash damper 26 is sized so that vertical sidewall 46 of damper 26 is in close proximity to tank sidewall 82 Sizing splash damper 26 so that vertical sidewall 46 is near tank sidewall 82 limits the lateral movement of splash damper 26 and maintains the alignment of dome portion 50 with suction opening 42. Splash damper 26 is preferably sized so that liquid and debris can flow freely between vertical sidewall 46 and tank sidewall 82, so that splash damper 26 floats freely upwardly as recovery tank 14 fills with liquid and so that dome portion 50 maintains a general alignment with suction opening 42.

Figure 7:
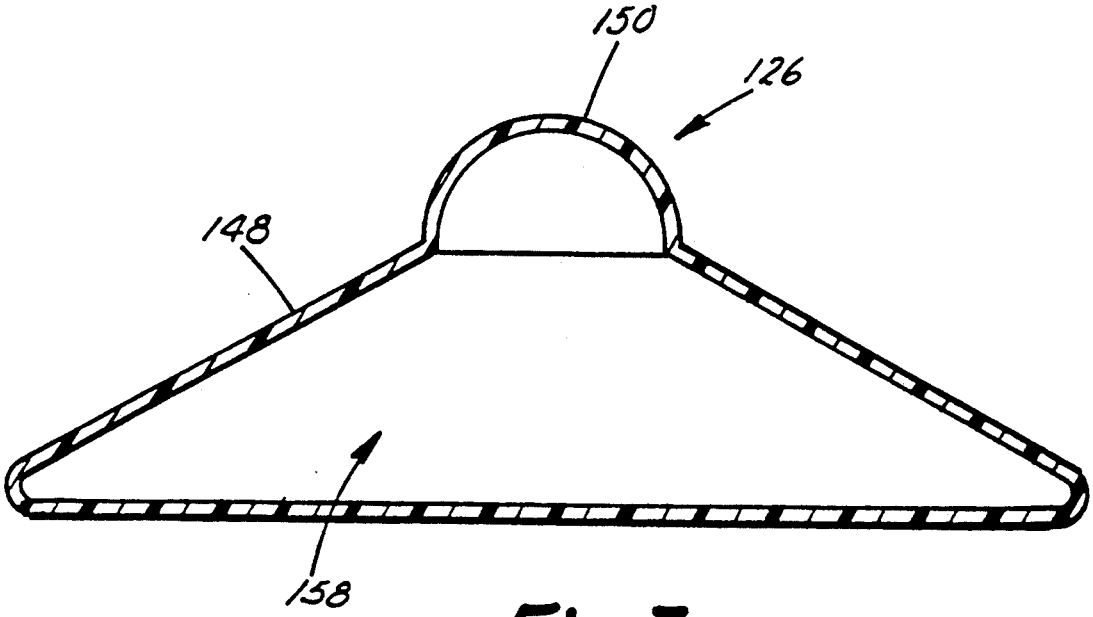
FIG. 7 is a sectional view of an alternative embodiment of the splash damper of FIG. 3.

In the alternative, a splash damper 126 as shown in FIG. 7 may be used. As with splash damper 26, splash damper 126 has a centrally positioned dome portion 150 and a truncated conic top surface 148. Splash damper 126, however, is a blown molded plastic member with an interior chamber 158 for flotation.

Figure 8:
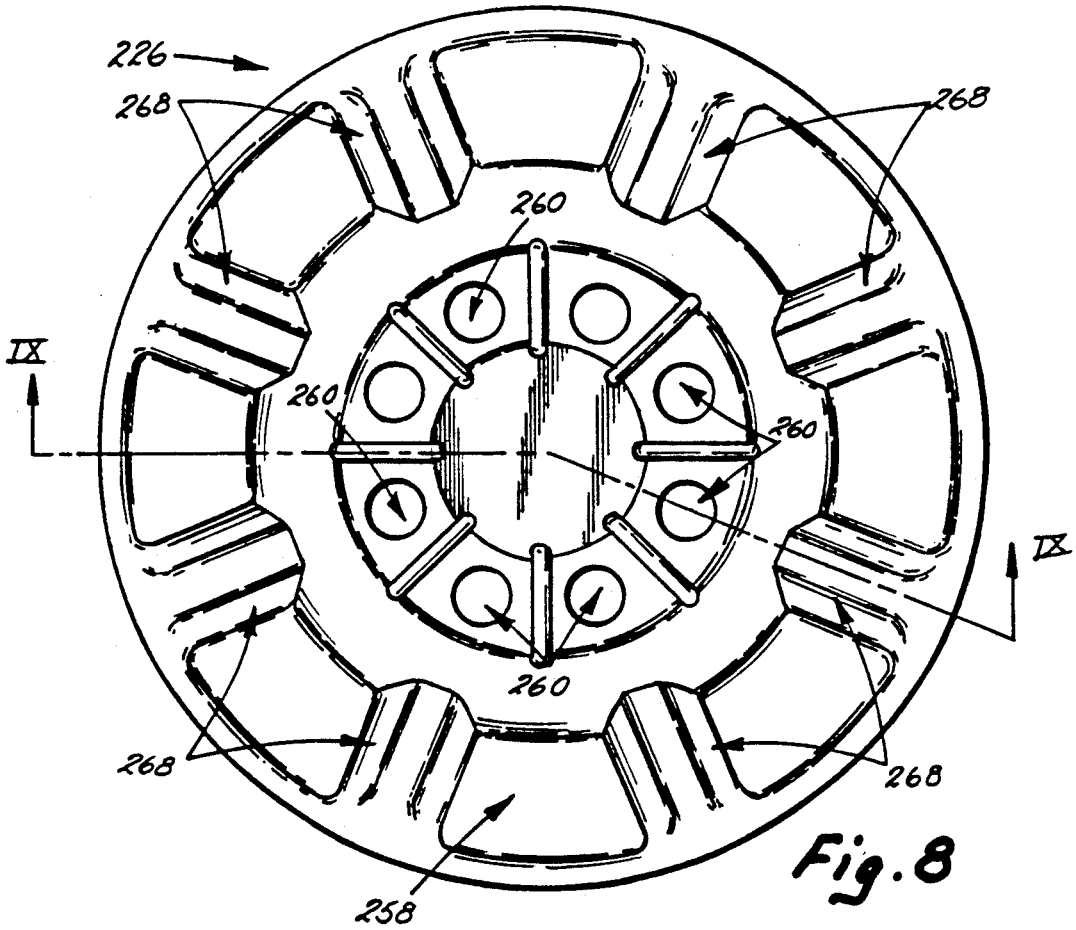
FIG. 8 is a bottom plane view of a second alternative embodiment of the splash damper of FIG. 3.
Figure 9:
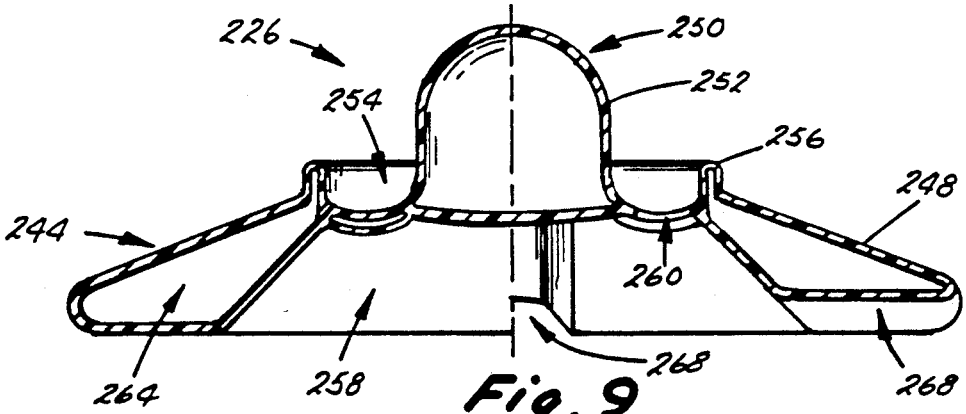
FIG. 9 is a sectional view of the splash damper of FIG. 8 as indicated by broken section line IX—IX.
Figure 10:
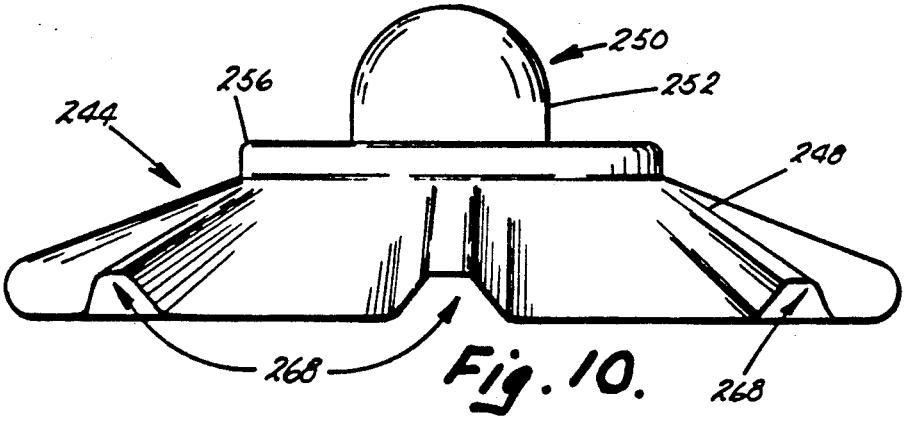
FIG. 10 is an elevational view of the splash damper of FIG. 8.

The best mode presently contemplated for the splash damper of the present invention is the blown molded splash damper 226 of FIGS. 8, 9 and 10.

Splash damper 226 includes a truncated conic base portion 244 with a sloping top surface 248, a centrally located dome portion 250 with steeply sloping sidewall 252 (FIGS. 9 and 10). A trough 254 circumscribes dome portion 250 and extends between sidewall 252 and top surface 248. A series of drainage openings 260 are positioned in the bottom of trough 254 to allow any foam or liquid which enters trough 254 to drain through splash damper 226 (FIGS. 8 and 9). An upwardly projecting vertical wall circumscribes trough 254 and defines a foam dam 256 (FIGS. 9 and 10). A downwardly open chamber 258 is defined by splash damper 226 (FIGS. 8 and 9). Flotation for splash damper 226 is provided by an annular flotation chamber 264 (FIG. 9). Further, a plurality of radially extending channels 268 are formed in the bottom surface of flotation chamber 264 to assure that liquid which is drawn into recovery tank 14 is not blocked from collecting beneath splash damper 226 (FIGS. 8, 9 and 10).

In use, splash damper 26 is placed inside recovery tank 14 and stands upon tank floor 80 (FIG. 2). Housing 12 is seated upon recovery tank 14 and carry handle 22 is raised to a vertical position, latching housing 12 and recovery tank 14 together (FIG. 1). As handle 22 is raised to latch housing 12 and recovery tank 14 together, each latch post 76 engages the inclined surface 86 of the corresponding catch 78 and slides up inclined surface 86 until each latch post 76 seats into each latch post receiving area 88 (FIGS. 5 and 6). Latch post stop 90 of each catch 78 prevents latch posts 76 from progressing beyond latch post receiving area 88, and carry handle 22 is stopped in a vertical position. A typical suction hose and cleaning tool are attached to suction hose connector 32 and extractor 10 is used for vacuum cleaning liquid from a surface.

When extractor 10 is turned on, vacuum motor assembly 40 draws air through suction opening 42 from recovery tank 14 (FIG. 2). This in turn draws air, liquid and debris through suction hose connector 32 into recovery tank 14. As debris and liquid stream through suction hose connector 32 into recovery tank 14, they enter separator chamber 38 and strike water and air separator baffle 34. The liquid and debris fall from baffle 34 into recovery tank 14, while the air flows around baffle 34 and out through suction opening 42. The debris and liquid which fall into recovery tank 14 will land on top surface 48 of splash damper 26. Because top surface 48 of splash damper 26 slopes downwardly from the center of the damper 26 to the perimeter of the damper 26, the debris and liquid will run off top surface 48 and down vertical sidewall 46 of damper 26 to collect on bottom 80 of tank 14.

As recovery tank 14 accumulates liquid, damper 26 will float upon the surface of the liquid and be raised toward the top of recovery tank 14. As damper 26 approaches suction opening 42, the distance between baffle 34 and damper 26 decreases and the effective suction around baffle 34 increases, causing some of the falling debris and liquid to be drawn toward the center of extractor 10 and damper 26. Further, as damper 26 approaches the top of recovery tank 14, floating upon the surface of accumulating liquid in recovery tank 14, air which is drawn into recovery tank 14 through suction hose connector 32 and drawn out of recovery tank 14 through suction opening 42 by vacuum motor assembly 40 creates a current along top surface 48 of damper 26 which flows from the vertical sidewall 46 to the dome portion 50 of damper 26. This current has a tendency to draw the debris and liquid which fall onto top surface 48 toward dome portion 50. However, foam dam 56 and steeply sloping sidewall 52 of dome portion 50 minimize such a migration of debris and liquid from vertical sidewall 46 to dome portion 50 of damper 26. Any liquid which does pass foam dam 56 will enter and drain from trough 54 through S-shaped openings 60. The S-shape of openings 60 does not allow a straight line between foam dam 56 and dome 50 without crossing a drain opening 60.

When recovery tank 14 has filled with liquid, dome portion 50 of damper 26 will engage suction opening 42 to fulfill the ball-float valve function and cut off the suction from recovery tank 14, through suction opening 42, before the liquid level in recovery tank 14 is so high that liquid is drawn through suction opening 42.

The entire liquid extractor 10 or only recovery tank 14 may be conveniently carried by handle 22 for appropriate emptying In either case, splash damper 26 will minimize any liquid splashing during carrying. Also, if housing 12 is removed and set aside while recovery tank 14 is carried alone, such is done with a minimum of mess as a ball-float valve cage, ball and filter do not project from the bottom of housing 12 and the liquid and debris which are associated with the ball-float valve assembly are not present with housing 12 of liquid extractor 10 of the present invention.

The above description is considered that of the preferred embodiment only. Modifications of the invention will occur to those who make or use the invention. Therefore, it is understood that the embodiment shown in the drawings and described above is merely for illustrative purposes and is not intended to limit the scope of the invention, which is defined by the following claims as interpreted according to the principles of patent law.

The embodiments of the invention in which an exclusive property or privilege is claimed are defined as follows:

1. A surface cleaning liquid extractor for vacuum extraction of liquid and debris from a surface comprising:

a recovery tank including an upwardly extending sidewall for receiving debris and liquid which are vacuumed from a surface;

a housing removably positioned upon said tank;

a vacuum hose connection means in fluid communication with said tank so that debris and liquid which are drawn in through said connection means are deposited into said tank;

suction means positioned in said housing for drawing debris and liquid through said vacuum hose connection means and into said tank;

an opening in the bottom of said housing whereby said suction means is in fluid communication with said tank; and a floating splash damper positioned within said recovery tank, said splash damper being free to float upon liquid collected in said tank as the liquid level rises in said tank, said splash damper defining a generally continuous surface over the majority of the upper surface of liquid collected in said tank whereby said splash damper minimizes the tendency for liquid in said tank to splash into said suction means in said housing, yet said splash damper having a perimeter spaced inwardly from said upwardly extending sidewall of said tank whereby liquid being drawn into said recovery tank can flow around said splash damper and collect below said splash damper.

2. The extractor defined in claim 1 wherein:

said splash damper has a top side and an opposing bottom side; and said splash damper is hydrodynamically stable so that when said splash damper is placed in said recovery tank with said top side facing upwardly, said splash damper will float upon said surface of said liquid with said top side remaining facing upwardly and said splash damper will not turn over.

3. The extractor defined in claim 2 wherein:

said splash damper has a generally dome-shaped portion on said top side; and said dome-shaped portion generally aligns with said opening in said bottom of said housing for sealing engagement with said opening to close the fluid communication between said suction means and said tank when said tank has filled with liquid to a predetermined level.

4. The extractor defined in claim 3 wherein said dome-shaped portion has steeply sloping sidewalls which extend downwardly to said top side of said splash damper.

5. The extractor defined in claim 4 wherein said top side and said bottom side define a closed flotation cell.

6. The extractor defined in claim 5 further including a handle for latching said housing to said tank, for carrying said extractor and for carrying said tank without said housing.

7. The extractor defined in claim 6 wherein said handle is a generally U-shaped member having a bite portion with a leg extending to one side of said bite portion from each of two ends of said bite portion, each said leg having an end away from said bite portion which is pivotally connected to said sidewall of said recovery tank and said ends being positioned opposite to each other, across said recovery tank, so that said handle pivots over the top of said housing and pivots down to the side of said recovery tank.

8. The extractor defined in claim 7 wherein:

a latching member is provided on each of said legs of said handle;

two catch members are provided on said housing, said catch members being positioned opposite to each other across said housing; and said catch members and said latch members cooperate with each other to latch said housing and said recovery tank together when said handle is pivoted to a generally vertical position, over the top of said housing.

9. The extractor defined in claim 4 wherein said splash damper further includes an annular trough which is formed in said top side and circumscribes said dome portion.

10. The extractor defined in claim 9 wherein said trough includes drainage openings for draining liquid from said trough, through said splash damper and into said tank.

11. The extractor defined in claim 10 wherein said splash damper further includes a wall portion which projects upwardly from said top side, near said trough and which generally circumscribes said trough.

12. The extractor defined in claim 11 wherein said splash damper further includes an annular flotation chamber.

13. The extractor defined in claim 12 wherein said flotation chamber comprises a downwardly open channel circumscribing said bottom side of said splash damper.

14. The extractor defined in claim 13 wherein said splash damper further includes a flotation material in said channel.

15. The extractor defined in claim 14 wherein a plurality of feet project downwardly from said bottom side of said splash damper to keep said bottom side from coming into sealing contact with the bottom of said recovery tank.

16. The extractor defined in claim 15 further including a handle for latching said housing to said tank, for carrying said extractor and for carrying said tank without said housing.

17. The extractor defined in claim 16 wherein said handle is a generally U-shaped member having a bite portion with a leg extending to one side of said bite portion from each of two ends of said bite portion, each said leg having an end away from said bite portion which is pivotally connected to said sidewall of said recovery tank, and said ends being positioned opposite to each other, across said recovery tank so that said handle pivots over the top of said housing and pivots down to the side of said recovery tank.

18. The extractor defined in claim 17 wherein:

a latching member is provided on each of said legs of said handle;

two catch members are provided on said housing, said catch members being positioned opposite to each other across said housing; and said catch members and said latch members cooperate with each other to latch s id housing and said recovery tank together when said handle is pivoted to a generally vertical position, over the top of said housing.

19. A surface cleaning liquid extractor for vacuum extraction of liquid and debris from a surface comprising:

a recovery tank including an upwardly extending sidewall for receiving debris and liquid which are vacuumed from a surface;

a housing removably positioned upon said tank;

a vacuum hose connection means in fluid communication with said tank so that debris and liquid which are drawn in through said connection means are deposited into said tank;

suction means positioned in said housing for drawing debris and liquid through said vacuum hose connection means and into said tank;

an opening in the bottom of said housing whereby said suction means is in fluid communication with said tank; and a floating splash damper positioned within said recovery tank, said splash damper having a perimeter spaced inwardly from said upwardly extending sidewall of said recovery tank, said splash damper having a top side and an opposing bottom side and said splash damper being hydrodynamically stable so that when said splash damper is placed in said recovery tank with said top side facing upwardly, said splash damper will flat upon said surface of said liquid with said top side remaining facing upwardly and said splash damper will not turn over.

20. The extractor defined in claim 19 wherein said splash damper has a generally dome-shaped portion on said top side for sealing engagement with said opening in said bottom of said housing to close the fluid communication between said section means and said tank when said tank is filled with liquid to a predetermined level.

21. The extractor defined in claim 20 wherein said dome-shaped portion has steeply sloping sidewalls which extend downwardly to said top side of said splash damper.

22. The extractor defined in claim 21 wherein said top side and said bottom side define a closed flotation cell.

23. The extractor defined in claim 21 wherein said splash damper further includes an annular trough which is formed in said top side and circumscribes said dome portion.

24. The extractor defined in claim 23 wherein said trough includes drainage openings for draining liquid from said trough, through said splash damper and into said tank.

25. The extractor defined in claim 24 wherein said splash damper further includes a wall portion which projects upwardly from said top side, near said trough and which generally circumscribes said trough.

26. The extractor defined in claim 25 wherein said splash damper further includes an annular flotation chamber.

27. The extractor defined in claim 26 wherein said flotation chamber comprises a downwardly open channel circumscribing said bottom side of said splash damper.

28. The extractor defined in claim 27 wherein said splash damper further includes a flotation material in said channel.

29. The extractor defined in claim 28 wherein a plurality of feet project downwardly from said bottom side of said splash damper to keep said bottom side from coming into sealing contact with the bottom of said recovery tank.

30. The extractor defined in claim 29 further including a handle for latching said housing to said tank, for carrying said extractor and for carrying said tank without said housing.

31. A surface cleaning liquid extractor for vacuum extraction of liquid from a surface comprising:

a recovery tank for receiving debris and liquid which are vacuumed from a surface;

a housing removably positioned upon said tank;

suction means in said housing;

vacuum hose connection means in fluid communication with said tank so that debris and liquid which are drawn in through said connection means are deposited into said tank;

a handle for latching said housing to said tank, for carrying said extractor and for carrying said tank without said housing, said handle having a generally U-shaped member having a bite portion with a leg extending to one side of said bite portion from each of two ends of said bite portion, each said leg having an end away from said bite portion which is pivotally connected to the side of said recovery tank and said ends being positioned opposite to each other, across said recovery tank, so that said handle pivots over the top of said housing and pivots down to the side of said recovery tank;

a latching member on each of said legs of said handle;

two catch members on said housing, said catch members being positioned opposite to each other across said housing; and said catch members and said latch members cooperating with each other to latch said housing and said recovery tank together when said handle is pivoted to a generally vertical position, over the top of said housing.

32. A surface cleaning liquid extractor for vacuum extraction of liquid and debris from a surface comprising:

a recovery tank including an upwardly extending sidewall for receiving debris and liquid which are vacuumed from a surface;

a housing removably positioned upon said tank;

a vacuum hose connection means in fluid communication with said tank so that debris and liquid which are drawn in through said connection means are deposited into said tank;

suction means positioned in said housing for drawing debris and liquid through said vacuum hose connection means and into said tank;

an opening in the bottom of said housing whereby said suction means is in fluid communication with said tank; and a floating cutoff having an upwardly projecting dome and being positioned within said recovery tank, said cutoff being free to float upon liquid collected in said tank as the liquid level rises in said tank and having a perimeter spaced inwardly slightly from said upwardly extending sidewall of said tank whereby said cutoff is free of frictional engagement with said sidewall but is maintained in alignment by said sidewall such that said dome is kept approximately in alignment with said opening and engages said opening when said cutoff is floated upwardly on the surface of rising water in said recovery tank.

* * * * *

UNITED STATES PATENT AND TRADEMARK OFFICE

CERTIFICATE OF CORRECTION

PATENT NO. : 5,086,537

DATED : February 11, 1992

INVENTOR(S) : David E. McDowell et al.

It is certified that error appears in the above-identified patent and that said Letters Patent is hereby corrected as shown below:

Column 4, Line 20:

After "sidewall 82" insert --.--

Column 5, Line 57:

After "emptying" insert --.--

Column 8, Claim 18, Line 2:

"s id" should be --said--

Column 8, Claim 19, Line 32:

"flat" should be --float--

Column 8, Claim 20, Line 38:

"section" should be --suction--

Signed and Sealed this

Fourteenth Day of September, 1993

Bruce Lehman

*Attest:*

BRUCE LEHMAN

*Attesting Officer*

*Commissioner of Patents and Trademarks*